US007275506B2

(12) United States Patent
Schäfer et al.

(10) Patent No.: US 7,275,506 B2
(45) Date of Patent: Oct. 2, 2007

(54) DEVICE FOR THE VARIABLE SETTING OF THE CONTROL TIMES OF GAS-EXCHANGE VALVES OF AN INTERNAL COMBUSTION ENGINE

(75) Inventors: Jens Schäfer, Herzogenaurach (DE); Martin Steigerwald, Erlangen (DE); Jonathan Heywood, Pettstadt (DE)

(73) Assignee: Schaeffler-KG, Herzogenaurach (DE)

( * ) Notice: Subject to any disclaimer, the term of this patent is extended or adjusted under 35 U.S.C. 154(b) by 29 days.

(21) Appl. No.: 11/379,424

(22) Filed: Apr. 20, 2006

(65) Prior Publication Data

US 2006/0236966 A1 Oct. 26, 2006

(30) Foreign Application Priority Data

Apr. 23, 2005 (DE) ..... 10 2005 018 957

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

2004/0206322 A1* 10/2004 Meintschel et al. ..... 123/90.17

* cited by examiner

*Primary Examiner*—Zelalem Eshete
(74) *Attorney, Agent, or Firm*—Lucas & Mercanti, LLP

(57) ABSTRACT

The invention relates to a device (1) for the variable setting of the control times of gas-exchange valves of an internal combustion engine, with a driving element (12), with a driven element (8) and with an adjusting gear (11) designed as a triple-shaft gear, the driving element (12) being mounted rotatably with respect to the driven element (8) on the latter or on the camshaft (9). The relative phase position of the driven element (8) with respect to the driving element (12) can be selectively varied or held by means of the adjusting gear (11). According to the invention, it is proposed to mount the driving element (12) on the driven element (8) by means of rolling bearings (19, 21).

Radial and/or axial forces can thereby be supported in an optimized way in terms of friction, as a result of which the efficiency of the device (1) is increased.

10 Claims, 4 Drawing Sheets

DEVICE FOR THE VARIABLE SETTING OF THE CONTROL TIMES OF GAS-EXCHANGE VALVES OF AN INTERNAL COMBUSTION ENGINE

FIELD OF THE INVENTION

The invention relates to a device for the variable setting of the control times of gas-exchange valves of an internal combustion engine, with a driving element drive-connected to a crankshaft, with a driven element drive-connected to a camshaft, and with an adjusting gear, the driving element being mounted rotatably with respect to the driven element on the latter or on the camshaft, and the relative phase position of the driven element with respect to the driving element being capable of being selectively varied or held by means of the adjusting gear.

BACKGROUND OF THE INVENTION

In internal combustion engines, camshafts are used for actuating the gas-exchange valves. The camshaft is mounted in the internal combustion engine in such a way that cams attached to it bear against cam followers, for example bucket tappets, drag levers or rocker arms. When the camshaft is set in rotation, the cams roll on the cam followers which, in turn, actuate the gas-exchange valves. Thus, by virtue of the position and shape of the cams, both the opening duration and the amplitude, but also the opening and closing time point of the gas-exchange valves, are defined.

Modern engine concepts tend towards designing the valve drive variably. On the one hand, the valve stroke and the valve opening duration are to be capable of a variable configuration up to the complete cut-off of individual cylinders. For this purpose, concepts, such as switchable cam followers, variable valve drives or electrohydraulic or electric valve actuations are provided. Furthermore, it has proved advantageous to be capable of influencing the opening and closing times of the gas-exchange valves while the internal combustion engine is in operation. It is likewise desirable to be able to influence the opening or closing time points of the inlet or outlet valves separately, so that, for example, a defined valve overlap can be set in a purposeful way. By the opening or closing time points of the gas-exchange valves being set as a function of the current characteristic diagram range of the engine, for example of the current rotational speed or the current load, the specific fuel consumption can be lowered, exhaust-gas behaviour can be influenced positively and the engine efficiency, maximum torque and maximum power can be increased.

The described variability in the time control of the gas-exchange valves is brought about by means of a relative change in the phase position of the camshaft with respect to the crankshaft. In this case, the camshaft is drive-connected to the crankshaft mostly via a chain, belt or gearwheel mechanism or via equivalent drive concepts. Between the chain, belt or gearwheel mechanism driven by the crankshaft and the camshaft, a camshaft adjuster is mounted, which transmits the torque from the crankshaft to the camshaft. In this case, this device for varying the control times of the internal combustion engine is designed in such a way that, while the internal combustion engine is in operation, the phase position between the crankshaft and camshaft can be held reliably, and, if desired, the camshaft can be rotated over a particular angular range with respect to the crankshaft.

In internal combustion engines with a camshaft in each case for the inlet and the outlet valves, these may be equipped in each case with a camshaft adjuster. As a result, the opening and closing times of the inlet and outlet gas-exchange valves can be displaced relative to one another in time and the valve time overlaps can be set in a purposeful way.

The seat of modern camshaft adjusters is generally located at the drive-side end of the camshaft. It consists of a driving wheel fixed with respect to the crankshaft, of a driven part fixed with respect to the camshaft and of an adjusting mechanism transmitting the torque from the driving wheel to the driven part. The driving wheel may be designed as a chain wheel, belt wheel or gearwheel and is connected fixedly in terms of rotation to the crankshaft by means of a chain, a belt or a gearwheel mechanism. The adjusting mechanism may be operated electromagnetically, hydraulically or pneumatically. It is likewise conceivable to mount the camshaft adjuster on an intermediate shaft or to mount it on a non-rotating component. In this case, the torque is transmitted to the camshafts via further drives.

Electrically operated camshaft adjusters consist of a driving wheel which is drive-connected to the crankshaft of the internal combustion engine, of a driven part which is drive-connected to a camshaft of the internal combustion engine, and of an adjusting gear. The adjusting gear is a triple-shaft gear with three components rotatable with respect to one another. In this case, the first component of the gear is connected fixedly in terms of rotation to the driving wheel and the second component is connected fixedly in terms of rotation to the driven part. The third component is operatively connected to the first and the second component, for example by means of pairs of toothings, articulated levers or friction-wheel pairings. The rotational speed of the third component is regulated, for example, by means of an electric motor or a braking device. By means of different numbers of teeth of the toothings of the three components, lever kinematics or different diameters of the friction wheels, a transmission ratio between the first and the second component which is unequal to 1 is implemented. The phase position can thereby be selectively held or varied by the choice of suitable rotational speeds of the third component.

The torque is transmitted from the crankshaft to the first component and from there to the second component and consequently to the camshaft. This takes place either directly or with the third component being interposed.

Via suitable regulation of the rotational speed of the third component, the first component can be rotated with respect to the second component and consequently the phase position between the camshaft and crankshaft can be varied. Examples of triple-shaft gears of this type are internal eccentric gears, double internal eccentric gears, harmonic drives, swashplate mechanisms, epicyclic gears, tungsten gears or the like.

To control the camshaft adjuster, sensors detect the characteristic data of the internal combustion engine, such as, for example, the load state, the rotational speed and the angular positions of the camshaft and crankshaft. These data are fed to an electronic control unit which, after comparing the data with a characteristic diagram of the internal combustion engine, controls the adjusting motor of the camshaft adjuster.

DE 102 48 355 discloses a device for varying the control times of an internal combustion engine, in which torque transmission from the crankshaft to the camshaft and the adjusting operation are carried out by means of a double epicyclic gear. The torque of the crankshaft is transmitted to a driving element of the device via a chain mechanism. The driving element is designed as a ring wheel, the internal toothing of the ring wheel meshing with external toothings of a plurality of planet wheels arranged on a planet carrier and designed as spur wheels. The external toothings of the spur wheels engage simultaneously into an internal toothing of a driven element which is designed as a ring wheel and which, in turn, is connected fixedly in terms of rotation to a camshaft. Furthermore, the toothings of the planet wheels mesh with an external toothing of a sun wheel which serves as an adjusting shaft and is driven by an electric motor. The phase position between the driving element and driven element is held or adjusted as a function of the rotational speed of the electric motor. So that the phase position of the two components can be varied, the driving element is mounted on the driven element rotatably with respect to the latter by means of a plain or rolling bearing.

The driving element is designed in the axial direction with a shoulder, by means of which it is supported in one axial direction on the driven element. The driving element is likewise supported on the driven element in the other direction by means of a spring ring. In this embodiment, the mountings are designed as plain bearings.

The adjustment of devices of this type is carried out via electric drives which regulate the rotational speed of an adjusting shaft. In order to design the electric drive cost-effectively and so as to be optimized in terms of construction space, a high efficiency of the device is desirable. A precondition for a high efficiency is minimal friction between the components of the device. In this regard, the plain-bearing mounting of the driving element with respect to the driven element has proved to be a disadvantage, especially in the case of high adjustment speeds and high tilting moments acting on the driving element.

OBJECT OF THE INVENTION

The object on which the invention is based is to provide a device for varying the control times of an internal combustion engine, in which friction within the device is to be reduced and therefore the efficiency of the device is to be increased. Particular attention is paid, at the same time, to the axial and radial mounting of the driving element with respect to the driven element.

SUMMARY OF THE INVENTION

The object is achieved, according to the invention, in that the driving element is supported in the axial direction by means of at least one rolling bearing.

In a first embodiment of the invention, the rolling bearing is designed as an axial rolling bearing.

Furthermore, there may be provision for the driving element to be supported in each of the two axial directions by means of an axial rolling bearing.

In a development, the driving element is supported on the driven element via the axial bearing or axial bearings.

In this case, the axial rolling bearing or axial rolling bearings may be designed as axial barrel bearings, needle bearings, needle sleeves, needle collars, axial angular ball bearings or axial grooved ball bearings.

In an advantageous development of the invention, there is provision for the driving element to be additionally mounted radially by means of a radial rolling bearing. In this case, the axial and radial rolling bearings may be separate bearings. It is likewise conceivable for these to be of one-piece design.

In a further embodiment of the invention, the rolling bearing is designed as a radial rolling bearing. In this case, the radial rolling bearing may be designed as a grooved ball bearing, four-point bearing, single-row or double-row angular ball bearing or shoulder-type ball bearing.

In an advantageous development of the two embodiments, at least one raceway of rolling bodies of the axial or radial rolling bearing may be formed on a component of the driving element or of the driven element.

The use of rolling bearings for mounting the driving element on the driven element contributes decisively to reducing the friction within the device and consequently to increasing its efficiency. The invention has a particularly advantageous effect in quick-action adjusting systems.

The use of axial bearings is particularly advantageous in applications where the driving wheel, which is designed, for example, as a chain or belt wheel, is not arranged symmetrically with respect to the bearing point in the axial direction. In this instance, high axial forces or tilting moments act on the driving element and have to be supported by the driven element or the camshaft.

In applications where there is provision for employing both axial and radial rolling bearings, separate bearings may be used. It is also conceivable to use combined radial/axial rolling bearings, with the result that the production costs of the device can be kept low.

The rolling bearings used may be equipped with separately manufactured inner or outer rings. It is likewise conceivable to form one or both running surfaces of the rolling bodies directly on the driven element, the camshaft or the driving element, with the result that the number of individual parts of the device can be lowered and therefore the production costs reduced.

BRIEF DESCRIPTION OF THE DRAWINGS

Further features of the invention may be gathered from the following description and the accompanying drawings which illustrate diagrammatically exemplary embodiments of the invention and in which.

DETAILED DESCRIPTION OF THE INVENTION

Figure 1:
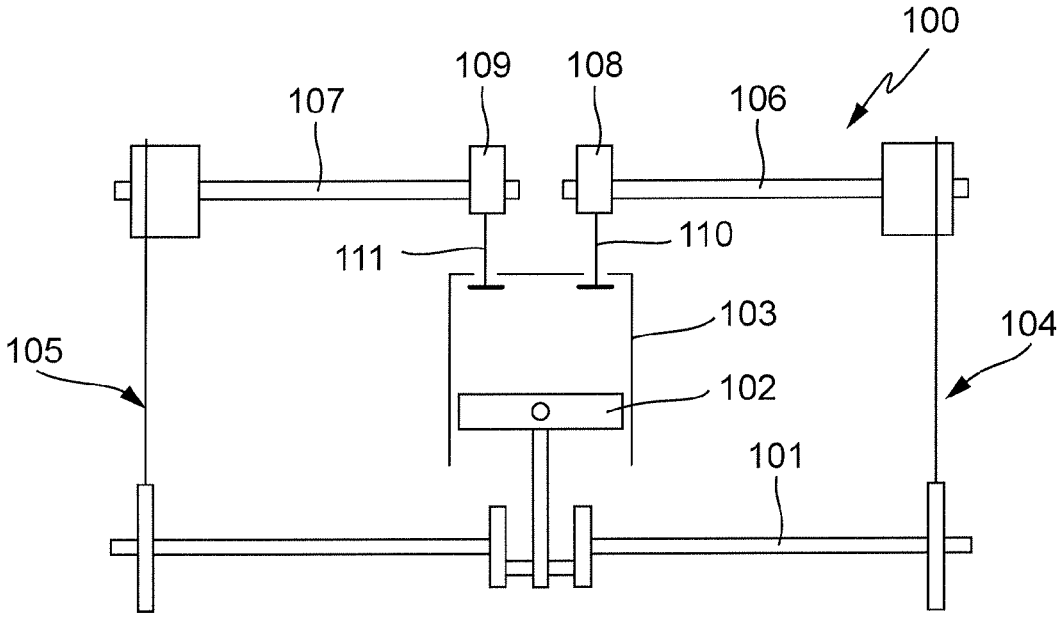
FIG. 1 shows an internal combustion engine merely highly diagrammatically.

An internal combustion engine 100 is sketched in FIG. 1, a piston 102 seated on a crankshaft 101 being indicated in a cylinder 103. In the embodiment illustrated, the crankshaft 101 is connected to an inlet camshaft 106 and an outlet camshaft 107 in each case via a traction mechanism 104 and 105, whilst a first and a second device 1 can ensure a relative rotation between the crankshaft 101 and camshafts 106, 107. Cams 108, 109 of the camshafts 106, 107 actuate an inlet gas-exchange valve 110 and the outlet gas-exchange valve 111 respectively.

Figure 2A:
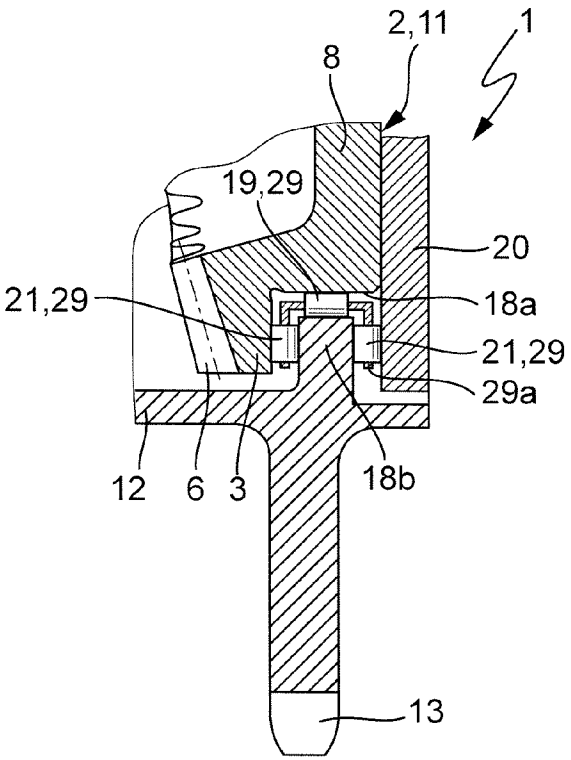
FIG. 2*a* shows the detail Z from FIG. 2.
Figure 2:
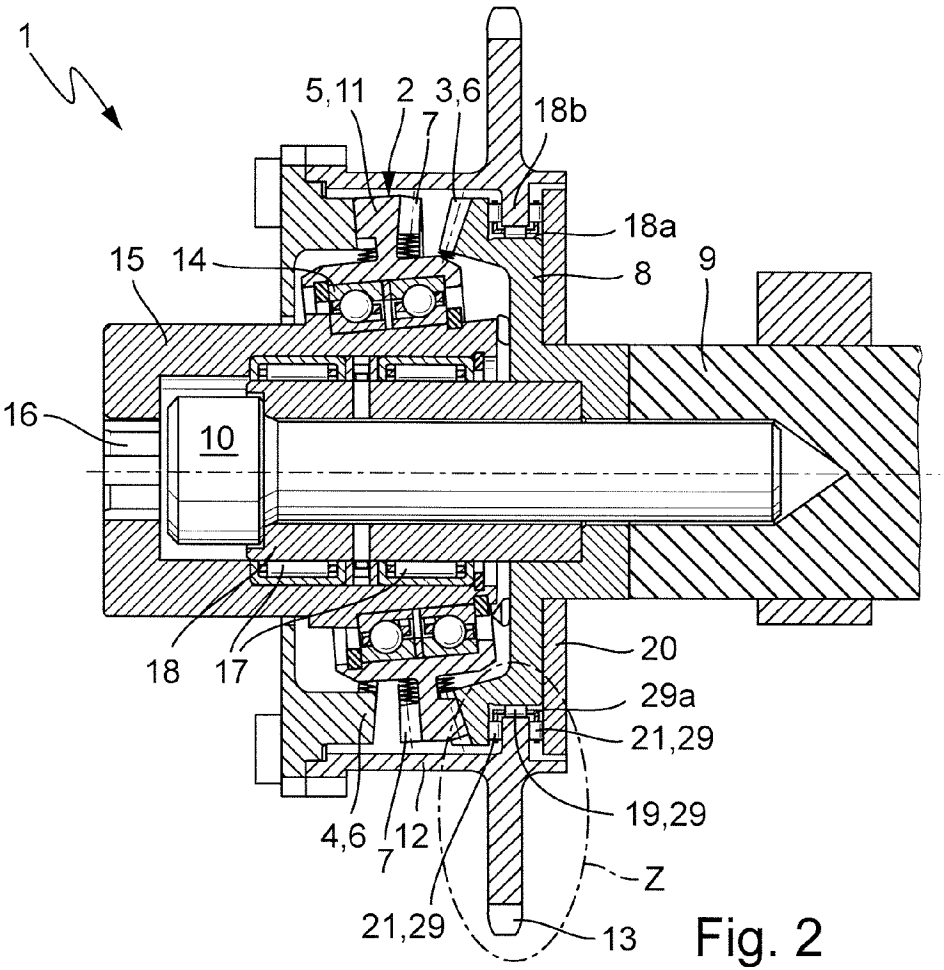
FIG. 2 shows a longitudinal section through a first embodiment according to the invention of a device for varying the control times of an internal combustion engine.

FIGS. 2 and 2*a* show an embodiment of a device 1 according to the invention for varying the control times of an internal combustion engine 100. In this case, FIG. 2*a* shows the detail Z from FIG. 2 in enlarged form.

The device 1 comprises, inter alia, an adjusting gear 11 designed as a swashplate mechanism 2 and consisting of a first bevel wheel 3, a second bevel wheel 4 and of a swashplate 5. A first toothed rim 6 designed as a bevel-wheel toothing is formed on the first bevel wheel 3. The swashplate 5 is designed with two second toothed rims 7 designed as a bevel-wheel toothing, in each case a second toothed rim 7 being arranged on an axial side face of the swashplate 5. In a similar way to the first bevel wheel 3, the second bevel wheel 4 has a first toothed rim 6 designed as a bevel-wheel toothing. The first bevel wheel 3 is connected fixedly in terms of rotation, by means of a driven element 8 produced in one piece with it, to a camshaft 9. The connection between the driven element 8 and the camshaft 9 may be implemented by means of a materially integral, non-positive, frictional or positive connection. In the exemplary embodiment illustrated, the driven element 8 is fastened to the camshaft 9 by means of a fastening screw 10.

The second bevel wheel 4 is connected fixedly in terms of rotation to a driving element 12 which is operatively connected via a driving wheel 13 to a primary drive, not illustrated, via which a torque is transmitted from the crankshaft 101 to the driving element 12. A primary drive of this type may be, for example, a chain drive, belt drive or gearwheel mechanism. The connection between the second bevel wheel 4 and the driven element 8 may be implemented by means of non-positive, positive, frictional or materially integral connections.

The two bevel wheels 3, 4 stand parallel to one another and are spaced apart from one another in the axial direction. The bevel wheels 3, 4 form, together with the driving element 12, an annular cavity in which the swashplate 5 is arranged. By means of first rolling bearings 14, the swashplate 5 is mounted on an adjusting shaft 15 at a defined angle of incidence with respect to the bevel wheels 3, 4. The adjusting shaft 15, of essentially pot-shaped design, is provided with a coupling element 16, into which engages a shaft, not illustrated, of a device, likewise not illustrated, by means of which the rotational speed of the adjusting shaft 15 can be regulated. A device of this type may be implemented, for example, by an electric motor or a brake. The adjusting shaft 15 is supported via a second rolling bearing 17 on a shaft which is connected fixedly in terms of rotation to the camshaft 9 and which is designed in the present embodiment as a hollow shaft 18. The mounting of the adjusting shaft 15 on the screw head of the fastening screw 10 and/or a mounting of the swashplate 5 on the adjusting shaft 15 by means of a plain bearing may likewise be envisaged.

The swashplate 5, arranged at a defined angle of incidence on the adjusting shaft 15, engages with one of the second toothed rims 7 into the first toothed rim 6 of the first bevel wheel 3 and with the other second toothed rim 7 into the first toothed rim 6 of the second bevel wheel 4. In this case, the respective toothed rims 6, 7 are in engagement only over a specific angular range, the size of which is dependent on the angle of incidence of the swashplate 5.

Via the engagement of the toothed rims 6, 7, the torque of the crankshaft 101, transmitted from the primary drive to the driving element 12 and from there to the second bevel wheel 4, is transmitted via the swashplate 5 to the first bevel wheel 3 and consequently, via the driven element 8, to the camshaft 9.

If, for example, an electric motor is used in order to regulate the phase position of the driven element 8 with respect to the driving element 12, the adjusting shaft 15 is driven at the rotational speed of the driving element 12, in order to hold the phase position between the camshaft 9 and crankshaft 101. If the phase position is to be changed, the rotational speed of the adjusting shaft 15 is raised or lowered, depending on whether the camshaft 9 is to lead or lag in relation to the crankshaft 101. Owing to the different rotational speed of the adjusting shaft 15, the swashplate 5 executes a wobbling rotation, the angular ranges in which the toothed rims 6, 7 engage one in the other revolving around the bevel wheels 3, 4. In the case of at least one of the pairs of toothed rims, the two toothed rims 6, 7 engaging one in the other have different numbers of teeth. When the angular ranges in which the toothed rims 6, 7 engage one in the other have revolved once completely, this results, on account of the difference in the number of teeth, in an adjustment of the first bevel wheel 3 with respect to the second bevel wheel 4 and consequently of the camshaft 9 in relation to the crankshaft 101. The angle of adjustment corresponds to the range which the teeth forming the difference in the number of teeth occupy. It is conceivable, in this respect, that the toothed rims 6, 7 of both pairs of toothed rims have different numbers of teeth. The adjustment reduction ratio consequently arises from the two resulting reduction ratios.

It is likewise conceivable that the toothed rims 6, 7 of only one toothed-rim pairing have different numbers of teeth. In this case, the reduction ratio arises only from this reduction. The other toothed-rim pairing serves in this case merely as coupling means with a reduction ratio of 1:1 between the swashplate 5 and the respective component. It is likewise conceivable, in this instance, to provide as coupling means a pin coupling instead of the second toothed-rim pairing, in which case pins attached to the swashplate 5 or to the driving element 12/driven element 8 or produced in one piece with the component engage into axially running grooves of the other component in each case.

The driven element 8 is of pot-shaped design, an annular portion 18*a* being formed. The driving element 12 is mounted, by means of a protuberance 18*b* formed on it, on this portion 18*a*. Furthermore, a stop disc 20 is provided, which limits the portion 18*a* and which is connected fixedly in terms of rotation to the driven element 8. The driving element 12 is mounted on the driven element 8 by means of a radial rolling bearing 19. In the embodiment illustrated, the radial rolling bearing 19 is designed as a needle collar, an outer surface area of the portion 18*a* and an inner surface area of the protuberance 18*b* serving as a running surface for the rolling bodies 29. Due to the use of the radial rolling bearing 19, the friction between these components which occurs during an adjusting operation decreases significantly. The efficiency of the device 1 rises, with the result that the electric drive of the adjusting shaft 15 can have a smaller and more cost-effective design. In addition to a needle bearing, for example, grooved ball bearings, four-point bearings, single-row or double-row angular ball bearings, shoulder-type ball bearings or tapered roller bearings may also be used.

In FIGS. 2 and 2*a*, in addition to the radial rolling bearing 19, two axial rolling bearings 21 are provided, which are designed as needle sleeves and mount the driving element 12 in the axial direction with respect to the first bevel wheel 3 and to the stop disc 20. In this instance, the axial rolling bearings 21 are produced in one piece with the radial rolling bearing 19, the rolling bodies 29 being guided by means of a cage 29*a*. Separate radial 19 and axial 21 rolling bearings may likewise be envisaged. The axial rolling bearings 21 used may also be axial barrel bearings, needle bearings, needle collars, axial angular ball bearings or axial grooved ball bearings. In this case, the axial rolling bearings 21 may also be designed with an inner and/or outer ring manufactured separately from the driven element 8 or the driving element 12. In this exemplary embodiment, it would also be conceivable to dispense with the radial rolling bearing 19 and use only axial rolling bearings 21.

If the radial rolling bearings 19 used are, for example, grooved ball bearings, four-point bearings, single-row or double-row angular ball bearings, shoulder-type ball bearings or tapered roller bearings, then axial forces acting on the driving element 12 can be supported at the same time. The axial rolling bearings 21 between the driving element 12 and the driven element 8 may therefore be dispensed with.

Figure 3:
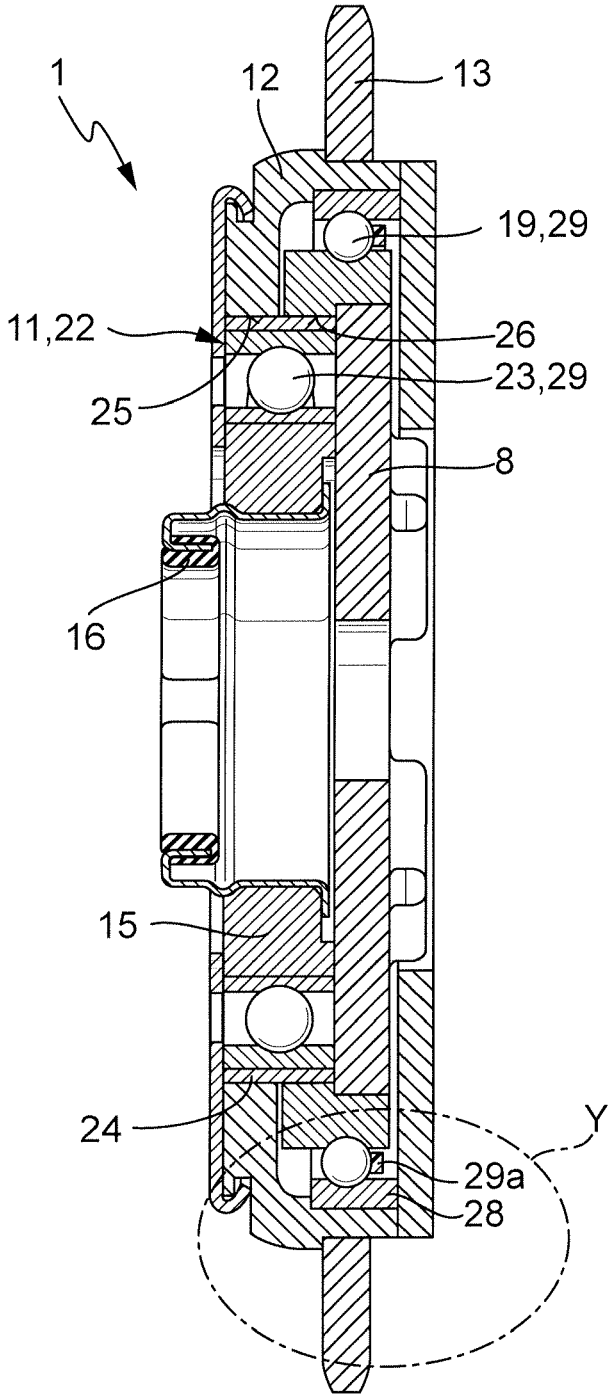
FIG. 3 shows a longitudinal section through a second embodiment according to the invention of a device for varying the control times of an internal combustion engine.

FIG. 3 shows a further embodiment of a device 1 according to the invention. In this instance, the adjusting gear 11 is designed as a harmonic drive 22. This has, inter alia, a driving wheel 13, via which the torque of the crankshaft 101 is transmitted to the device 1 by means of a primary drive, not illustrated. The driving wheel 13 is connected fixedly in terms of rotation to the driving element 12 by means of a non-positive, materially integral or positive connection. Furthermore, a driven element 8 is provided, which is connected fixedly in terms of rotation to a camshaft, not illustrated.

The drive torque of the crankshaft 101 is transmitted to the driven element 8 via the driving wheel 13 and the driving element 12 by means of a harmonic drive 22. The harmonic drive 22 consists of an adjusting shaft 15 shaped elliptically in cross section, of a third rolling bearing 23, of a spur wheel 24 designed as a flexible sleeve and of two ring wheels 25, 26. In each case one of the ring wheels 25, 26 is formed on the driven element 8 and on the driving element 12. The adjusting shaft 15 is arranged concentrically with respect to the driven element 8 and to the driving element 12 and has a coupling element 16, via which the said adjusting shaft cooperates with an actuating drive, not illustrated. The third rolling bearing 23, designed as a ball bearing, is arranged on an outer circumferential surface of the adjusting shaft 15. An inner ring 27 of the third rolling bearing 23 is adapted to the outer circumference of the adjusting shaft 15 and is thus likewise designed elliptically. The spur wheel 24 is arranged on the outer circumferential surface of an outer ring 28 of the third rolling bearing 23. The outer ring 28 and spur wheel 24 are designed flexibly, with the result that these are adapted to the elliptic contour of the inner ring 27 or of the adjusting shaft 15. The external toothing of the spur wheel 24 engages, in two angular ranges lying opposite one another, both into the internal toothing of the ring wheel 25 and into the internal toothing of the ring wheel 26. Outside these angular ranges, the toothings are not in engagement. The torque transmitted from the crankshaft 101 to the driving element 12 is transmitted to the driven element 8 via the two spur-wheel/ring-wheel toothing pairs. There is provision, in this case, for the internal toothings of the ring wheels 25, 26 to have different numbers of teeth.

In order to hold the phase position of the camshaft 9 in relation to the crankshaft 101, the adjusting shaft 15 is driven at the rotational speed of the driving wheel 13. If the phase position is to be adjusted, the rotational speed of the adjusting shaft 15 is raised or lowered in relation to the rotational speed of the driving wheel 13. The elliptic adjusting shaft 15 is thereby rotated in relation to the driving element 12, with the result that the angular ranges in which the spur-wheel and ring-wheel toothings are in engagement revolve around the spur wheel 24 or the ring wheels 25, 26. This gives rise, on account of the difference in the numbers of teeth between the two ring wheels 25, 26, in a rotation of the driven element 8 with respect to the driving element 12 and consequently in a variation of the phase position between the camshaft 9 and crankshaft 101.

The driving element 12 is mounted on the driven element 8 by means of a radial rolling bearing 19. In this case, the radial rolling bearing 19 may be designed as a grooved ball bearing, four-point bearing, single-row or double-row angular ball bearing, shoulder-type ball bearing or the like. By these bearings being used, the driving element 12 is supported with respect to the driven element 8 both in the axial and in the radial direction, with the result that an axial guide having a plain-bearing mounting and radial plain bearings may be dispensed with.

As in the first embodiment, in harmonic drives 22, too, it is conceivable to provide a needle bearing as the radial rolling bearing 19. In this instance, once again, an axial rolling bearing 21, such as, for example, an axial barrel bearing, a needle bearing, a needle sleeve, a needle collar, an axial angular ball bearing or an axial grooved ball bearing, is advantageously to be provided, in order to support the driving element 12 axially with respect to the driven element 8 in an optimized way in terms of friction.

In the embodiment illustrated in FIG. 3, a ball bearing is arranged between the driving element 12 and the driven element 8, an outer circumferential surface of the driven element 8 serving as a raceway for the rolling bodies 29.

Figure 3A:
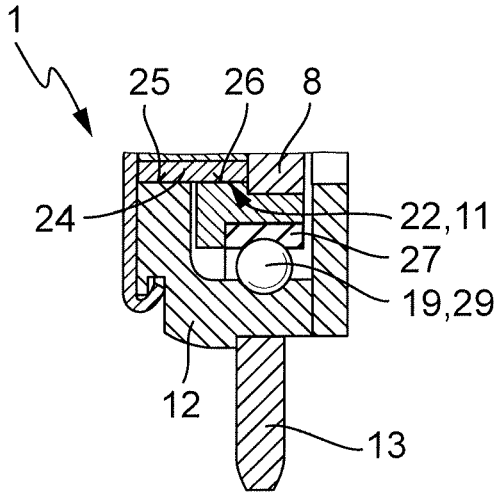
FIG. 3*a* shows a third embodiment according to the invention of a device for varying the control times of an internal combustion engine, only the detail Y from FIG. 3 being illustrated.

FIG. 3*a* shows a modification of the device 1 according to the invention illustrated in FIG. 3. In this embodiment, once again, the driving element 12 is mounted on the driven element 8 by means of a radial rolling bearing 19. In this instance, an inner circumferential surface of the driving element 12 serves as a raceway for the rolling bodies 29. An embodiment may, of course, also be envisaged, in which the radial rolling bearing 19 is provided both with a separate inner and a separate outer ring (27, 28). Embodiments may also be envisaged in which both an outer circumferential surface of the driven element 8 and an inner circumferential surface of the driving element 12 serve as running surfaces for the radial rolling bearing 19. By the raceways of the rolling bodies 29 being formed on components of the harmonic drive 22, the number of components is reduced, thus having a positive effect on the construction space, the weight, the outlay in terms of assembly and the costs of the device 1.

Figure 4:
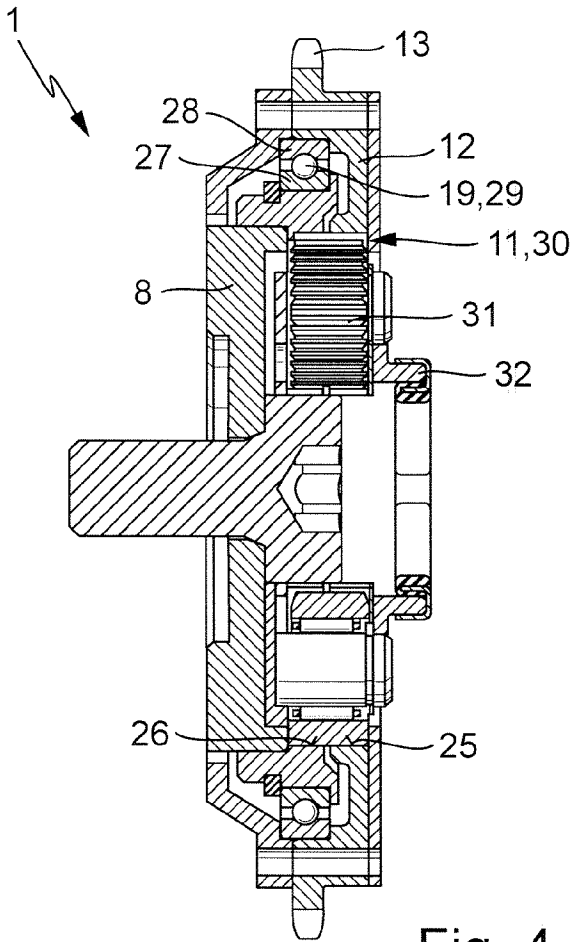
FIG. 4 shows a longitudinal section through a fourth embodiment according to the invention of a device for varying the control times of an internal combustion engine.

FIG. 4 shows a further embodiment according to the invention of the device 1. This, again, has a driving wheel 13 and a driven element 8, the driving wheel 13 being connected fixedly in terms of rotation to the crankshaft 101 via a primary drive, not illustrated, and the driven element 8 being connected fixedly in terms of rotation to a camshaft 9. The driving element 12 is produced in one piece with the driving wheel 13. In this embodiment, the adjusting gear 11 is designed as a double epicyclic gear 30. This consists of a ring wheel 25 formed on an inner surface area of the driving element 12, of a second ring wheel 26 formed on an inner circumferential surface of the driven element 8 and of a plurality of planet wheels 31 which are mounted rotatably on a planet carrier 32. The planet wheels 31 are designed as spur wheels. The planet carrier 32 cooperates with a coupling element 16, via which the latter can be driven by an electric actuating unit, not illustrated. The external toothings of the planet wheels 31 engage both into the internal toothing of the first ring wheel 25 and into the internal toothing of the second ring wheel 26. The two internal toothings of the ring wheels 25, 26 have unequal numbers of teeth. On account of the different numbers of teeth between the two internal toothings of the ring wheels 25, 26, the result of this is that, during the rotary drive of the planet carrier 32, a relative movement between the two ring wheels 25, 26 and consequently between the driven element 8 and the driving element 12 is brought about. This has the effect of varying the phase position between the crankshaft 101 and the camshaft 9. As illustrated in FIG. 4, in this embodiment, too, the driving element 12 is mounted on the driven element 8 by means of a radial rolling bearing 19.

Figure 5:
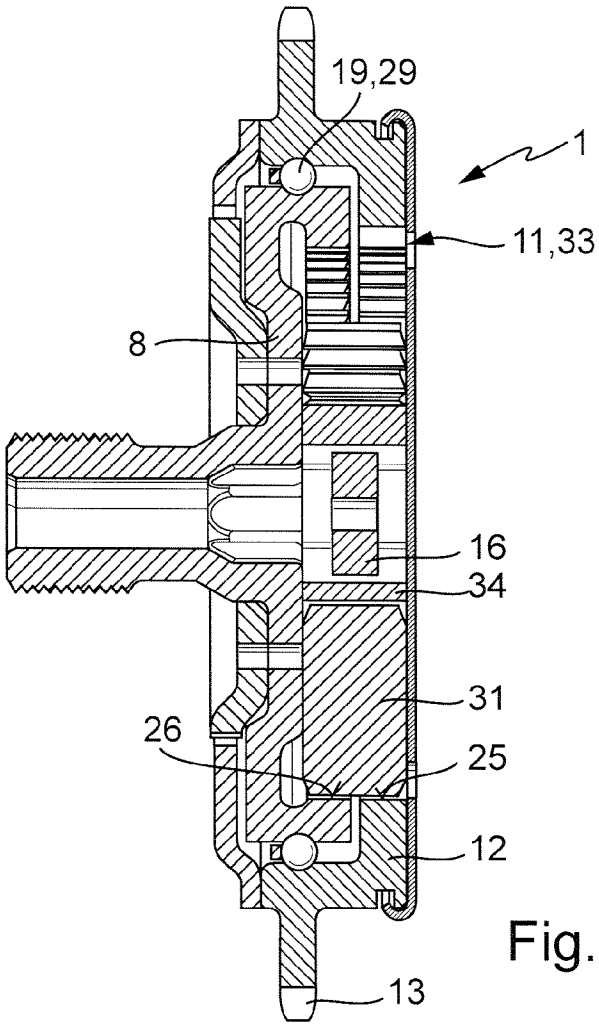
FIG. 5 shows a longitudinal section through a fifth embodiment according to the invention of a device for varying the control times of an internal combustion engine.

FIG. 5 shows a further embodiment according to the invention of the device 1, in this instance the adjusting gear 11 being designed as a tungsten gear 33. This gear resembles the double epicyclic gear 30 illustrated in FIG. 4, but with the difference that a sun wheel 34 is additionally provided. The sun wheel 34 is designed as a spur wheel, the planet wheels 31 in this case meshing both with the ring wheels 25 and 26 and with the sun wheel 34. In contrast to the embodiment illustrated in FIG. 4, here, the sun wheel 34 is driven by an electric actuating device, not illustrated.

In this embodiment, too, the driving element 12 is mounted on the driven element 8 by means of a radial rolling bearing 21.

In the embodiments illustrated in FIGS. 4 and 5, the same bearing strategies which were presented in the first two embodiments may be applied. The axial support of the driving element 12 on the driven element 8 may take place by means of suitable radial rolling bearings 19 or special axial rolling bearings 21, combinations and one-piece versions of these bearings also being possible.

In all the embodiments, of course, the radial rolling bearings 19 used may be needle bearings, tapered roller bearings, grooved ball bearings or angular ball bearings. It is also conceivable, in the embodiments in which tungsten gears, double epicyclic gears or harmonic drives (33, 30, 22) are used, to mount the driven element 8 in relation to the driving element 12 by means of axial rolling bearings 21. All the rolling bearings may be designed with separately manufactured inner and/or outer rings (27, 28). It is also conceivable for the running surfaces of the rolling bodies 29 to be formed directly on the driving element 12 or the driven element 8.

By radial or axial rolling bearings (19, 21) being used, the friction occurring in the device 1 is reduced considerably, and consequently the efficiency of the device 1 is increased. The result of this is that the electric actuating drives need to apply less power and therefore the axial construction-space requirement falls and production becomes more cost-effective. The use of rolling bearings is particularly advantageous in the case of quick-action adjusting devices 1, the axial rolling bearings 21 being particularly advantageously in embodiments in which the driving wheel 13 is arranged asymmetrically with respect to the bearing point on the device 1 and consequently high axial forces or tilting moments have to be supported.

List of reference numerals

| | |
|---|---|
| 1 | Device |
| 2 | Swashplate mechanism |
| 3 | First bevel wheel |
| 4 | Second bevel wheel |
| 5 | Swashplate |
| 6 | First toothed rim |
| 7 | Second toothed rim |
| 8 | Driven element |
| 9 | Camshaft |
| 10 | Fastening screw |
| 11 | Adjusting gear |
| 12 | Driving element |
| 13 | Driving wheel |
| 14 | First rolling bearing |
| 15 | Adjusting shaft |
| 16 | Coupling element |
| 17 | Second rolling bearing |
| 18 | Hollow shaft |
| 18a | Portion |
| 18b | Protuberance |
| 19 | Radial rolling bearing |
| 20 | Stop disc |
| 21 | Axial rolling bearing |
| 22 | Harmonic drive |
| 23 | Third rolling bearing |
| 24 | Spur wheel |
| 25 | Ring wheel |
| 26 | Ring wheel |
| 27 | Inner ring |
| 28 | Outer ring |
| 29 | Rolling body |
| 29a | Cage |
| 30 | Double epicyclic gear |
| 31 | Planet wheel |
| 32 | Planet carrier |
| 33 | Tungsten gear |
| 34 | Sun wheel |
| 100 | Internal combustion engine |
| 101 | Crankshaft |
| 102 | Piston |
| 103 | Cylinder |
| 104 | Traction mechanism |
| 105 | Traction mechanism |
| 106 | Inlet camshaft |
| 107 | Outlet camshaft |
| 108 | Cam |
| 109 | Cam |
| 110 | Inlet gas-exchange valve |
| 111 | Outlet gas-exchange valve |

The invention claimed is:

1. Device (1) for the variable setting of the control times of gas-exchange valves of an internal combustion engine, with a driving element (12) drive-connected to a crankshaft (101), a driven element (8) drive-connected to a camshaft (9), and an adjusting gear (11), the driving element (12) being mounted rotatably with respect to the driven element (8) on the latter or on the camshaft (9), and the relative phase position of the driven element (8) with respect to the driving element (12) being capable of being selectively varied or held by means of the adjusting gear (11), characterized in that the driving element (12) is supported in the axial direction by means of at least one rolling bearing (19, 21).

2. Device according to claim 1, characterized in that the rolling bearing (21) is designed as an axial rolling bearing.

3. Device according to claim 2, characterized in that the driving element (12) is supported in each of the two axial directions by means of an axial rolling bearing (21).

4. Device according to claim 2, characterized in that the driving element (8) is supported on the driven element (8) via the axial bearing or axial bearings (21).

5. Device according to claim 2, characterized in that the axial rolling bearing or axial rolling bearings (21) is or are designed as axial barrel bearings, needle bearings, needle sleeves, needle collars, axial angular ball bearings or axial grooved ball bearings.

6. Device according to claim 2, characterized in that the driving element (12) is additionally mounted radially by means of a radial rolling bearing (19).

7. Device according to claim 6, characterized in that the axial (21) and radial (19) rolling bearings are produced in one piece.

8. Device according to claim 1, characterized in that the rolling bearing is designed as a radial rolling bearing (19).

9. Device according to claim 8, characterized in that the radial rolling bearing (19) is designed as a grooved ball bearing, four-point bearing, single-row or double-row angular ball bearing or shoulder-type ball bearing.

10. Device according to claim 1, characterized in that at least one raceway of rolling bodies (29) of the axial (21) or radial (19) rolling bearing is formed on a component of the driving element (12) or of the driven element (8).

* * * * *